US005842963A

United States Patent [19]

Meesters

[11] Patent Number: 5,842,963

[45] Date of Patent: Dec. 1, 1998

[54] FOLDING AID FOR PAPER OF A STANDARD SIZE

[76] Inventor: Jacobus Meesters, Elbert Mooylaan 43, 1241 BB Kortenhoef, Netherlands

[21] Appl. No.: 765,384

[22] PCT Filed: Jun. 14, 1995

[86] PCT No.: PCT/NL95/00211

§ 371 Date: Dec. 13, 1996

§ 102(e) Date: Dec. 13, 1996

[87] PCT Pub. No.: WO95/34433

PCT Pub. Date: Dec. 21, 1995

[30] Foreign Application Priority Data

Jun. 14, 1994 [NL] Netherlands ..... 9400972

[51] Int. Cl.[6] ..... B31B 1/26

[52] U.S. Cl. ..... 493/405; 493/480

[58] Field of Search ..... 493/405, 480

[56] References Cited

U.S. PATENT DOCUMENTS

| | | | |
|---|---|---|---|
| 192,102 | 6/1877 | Watriss | 493/405 |
| 747,085 | 12/1903 | Rieffel | 493/405 |
| 3,092,379 | 6/1963 | Collier | 493/405 |
| 4,421,500 | 12/1983 | Smith | 493/405 |
| 5,057,070 | 10/1991 | Pidcock | 493/405 |
| 5,348,526 | 9/1994 | Feygin | 493/405 |
| 5,378,222 | 1/1995 | Weber | 493/405 |
| 5,380,265 | 1/1995 | Giovinazzo | 493/405 |

*Primary Examiner*—Jack W. Lavinder

[57] ABSTRACT

The invention relates to a folding board for folding paper (A) of a standard size, such as stationary, to which end the folding board is provided with position checks (2,3) for holding the paper to be folded in position as well as with a folding mark (4). Thanks to the folding mark (4) it is possible to quickly and accurately fold paper in three. Further folding marks make the folding board suitable for different standard paper sizes, such as DIN A4 and US letter paper. Using the aid, paper can also quickly, easily and accurately be folded double or folded twice double.

5 Claims, 1 Drawing Sheet

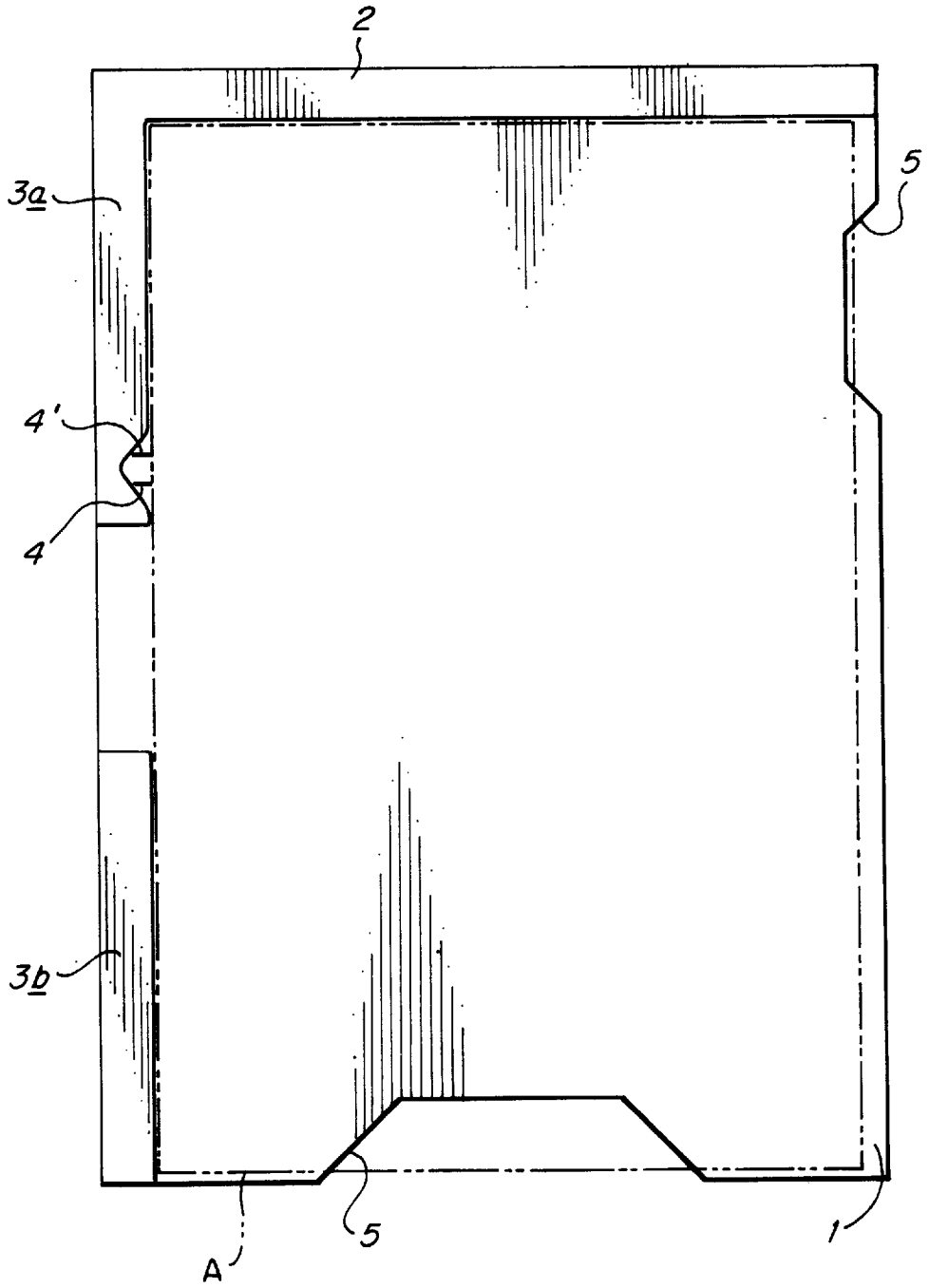
2
3a
5
4'
4
3b
5
A
1

FOLDING AID FOR PAPER OF A STANDARD SIZE

The present invention relates to an aid made one piece for folding paper of a standard size, in particular stationary.

Such an aid is described in the European patent application 0 523 977. In this case the aid is a device consisting of three rectangular members, whereby a middle member is connected along the two long sides with the long side of another member by means of hinge means. For folding a sheet of paper the sheet of paper is placed with its short side against the first hinge, which is situated between the first and middle member, the first member is turned onto the middle member, whereby a third part of the sheet of paper is positioned between the first and the middle member, and then the third member is turned onto the first member, forming a first fold in the sheet of paper. To form the second fold the paper is folded back onto the third member. To this end a fourth member may be provided being hinged to the middle member at the same long side as the first member.

The disadvantages of such an aid are that because of the thickness of a member the creases are not sharp, the presence of a staple can cause problems with folding and the folded paper has to be taken out of the device. For the latter purpose the device must either be folded out again, or the sheet of paper has to be pulled out sideways from the device which in that case is not ready for further use. Finally, the hinges of the aid are weak spots; they may tear.

It is the object of the present invention to provide an aid as described in the preamble, which aid produces sharply creased paper, is not limited to one standard size of paper and which allows paper also to be folded quickly double or in four. It is further the object of the invention to provide the possibility to fold paper in three in two different ways. Finally, it is the object of the invention to provide a robust aid in which the removal of the paper is not impeded.

To this end the aid according to the invention is characterized in that the aid comprises a base plate provided with position checks to allow the paper to be folded to be held in position, whereby the position checks may engage two adjacent sides of the paper, while the aid is provided with a folding mark which is visible next to the long side of the paper when the paper is placed in the fixed position, and the width of the base plate at the level of the fold to be formed is at least the same as that of the paper to be folded.

The folding aid according to the invention makes it possible to obtain sharp creases in one go and folded paper can be picked up without any impediment. Also, the device has no parts which are weak and sensitive to wear.

Folding paper by hand without any aids is known, but more often than not this gives less good results, especially when paper has to be folded in three. To facilitate folding paper in three it is known to provide the paper with a mark. Such a mark mars the paper and is therefore not applied to stationary used by management directors. Of course, it is possible to printing technically make the mark less conspicuous but then it becomes a greater strain on the eyes when folding the paper.

As with the folding aid according to the invention the folding mark is not on the paper itself, it may be very conspicuous, thus facilitating folding as the eyes are less strained. The position checks allow part of the folding actions to be carried out by touch thus giving an excellent folding result. At the same time folding is accomplished faster than without any aid.

From the German patent specification No. 234448 an aid is known which is provided with position checks for the positioning of paper, as well as with sprung strips around which the paper is folded. In order to allow more than one sheet of paper to be folded at once, the height of these strips is adjustable. The device must also be adjusted when changing from folding paper in three to folding it double. As with European patent application 0 523 977 this device has the disadvantage that it is not possible to obtain sharp creases in one go. In order to place a sheet of paper it has to be introduced into the device under the strips, and folded paper must be removed from the device. This is a limitation to the efficiency.

The aid described in the German "Gebrauchsmuster" G 92 13 946.9. is a device for electrically folding paper.

Such automatic paper fold devices are expensive and the cheapest and simplest devices can only fold one page per action, so that to fold a batch of paper comprised of several sheets each, the different, separately folded sheets have to be put together by hand, thus cancelling out part of the saving of labour. The price of the automatic folding device makes it uninteresting for small offices or home use. Larger offices also will only have a limited number of automatic folding devices, which means that employees waste time going to the centrally located automatic folding device.

According to one preferred embodiment the aid is provided with several folding marks for different standard paper sizes.

In this way a universally applicable aid is provided.

According to another embodiment the base plate is provided with a recess to allow taking hold of the paper, which recess does not overlap that part of the base plate which is positioned at the height of the fold to be formed.

Such a recess facilitates the placing and folding of the paper to be folded.

The invention will now be elucidated with reference to the drawing which shows an embodiment of the invention.

The FIGURE represents a schematic top view of the aid.

According to the embodiment shown the aid comprises a base plate 1 which is provided with a first position check 2 and a second position check 3. The position checks 2 and 3 define an angle of 90° for contacting two adjacent edges of the paper A, represented by a broken line. In the embodiment shown the position checks 2 and 3 each consist of an edge standing at right angles to the base plate 1. The height of the position checks may be, for instance, 0.5 to 1 cm. In order to place the paper A as securely as possible it is preferred that widely separated parts of a side of the paper A are contacted by a position check. If the paper A is to be folded more than once, the position checks 2,3 are preferably formed such that their contact with the paper which is to be folded at least once, also extends over as long a distance as possible. In the embodiment shown this happens over the full width of the paper A. For contacting, position check 3 comprises check parts 3*a* and 3*b* which will be further discussed below. The aid is further provided with a folding mark 4 which may be provided on the position check 3 or on the base plate 1, such that folding mark 4 is visible when the paper A is placed with two adjacent sides against position checks 2 and 3. The folding mark 4 may be provided on the position check 3 at the side facing the paper or on the base plate 1, whereby the position check 3 allows the base plate to be visible at the level of the folding mark. The width of the base plate 1 is at the level of the folding mark 4 preferably the same or greater than the width of the paper A. In this way the base plate 1 supports the paper A over the whole width of the fold to be formed avoiding the occurrence of any false creases across the desired fold. The folding mark 4 is preferably positioned at the side of the second position check 3—either on the base plate or on the position check 3 itself—so that when placing the side of the paper that is folded back onto the correct place indicated by folding mark 4, the person who is folding has to consider only one dimension, as position check 3 is also the position check for the side which is folded back. Thus correct folding of the paper is promoted. It goes without saying that several sheets of paper can be folded at the same time. Because good results are obtained easily and quickly, the threshold for folding in three is lowered and, as the envelope used for a letter folded in three is lighter, it may lead to lower postage costs. Using the aid according to the invention a letter can be folded into the "⊔" form as well as into the Z form.

The position checks 2 and 3 may in certain places be lowered or interrupted and this is particularly advantageous for the second position check 3 at the level of a fold to be formed, giving the person who is folding more freedom of movement. To this end the position check 3 is in the represented embodiment interrupted and comprises position checks 3*a* and 3*b*. To further increase freedom of movement position check 3*b* is bevelled in the direction of position check 3*a*. Nevertheless, for folding the paper A in three the position check 3 has, preferably at a point at least a little less than ⅔ of the length of the paper before the first position check, a height of at least 0.5 mm. This ensures that also during folding the paper remains in a fixed position as securely as possible. The device is also suitable for folding paper double or twice double and this is achieved faster than without an aid. For folding double for the second time the position check 3, if interrupted, is designed such that the once folded paper A can be placed fixedly against the position check 3 and position check 2, because the paper A engages over sufficient length. The position checks 2,3 may be executed in various forms, as rectangular elements as represented in the embodiment, but, for instance also as cylindrical studs protruding from the base plate.

The folding mark 4 may have various forms such as a groove, arrow, triangle or line, but may also be in the form of a tab which, dependent on the standard paper size used, can be positioned on a different place on the second position check 3. The folding mark 4 may also be formed by the end of position check 3*a* turned toward position check 3*b*.

By using further folding marks 4,4' it is possible to fold paper of different standard sizes, such as DIN A4 (210×297 m) and US letter paper (8½×11 inch). In that case the width of the base plate 1 is, measured from the position check 2,3, preferably at least that of the US letter paper and the length that of the DIN A4 paper.

In order to facilitate the placing of the paper A against the position checks 2,3 the base plate 1 is preferably provided with one or more recesses 5, which recesses 5 do not overlap that part of the base plate 1 which lies at the height of the fold to be formed.

In the case that the base area available for the paper A is of the same size as the paper to be folded, the base plate 1 is preferably rounded off or bevelled at the side where the paper to be folded is placed, at a rim or part of a rim opposite position check 3. This contributes to the ability to position and fold the paper easily and by touch. For the same reason the base plate 1 is preferably at least 4 mm thick. For an aid provided with several marks 4,4' for folding different standard sizes of paper it is advantageous to provide the aid with both the recesses 5 and the rounding-off or bevelling. If the recess 5 is large enough for its edge to correspond with the positioned paper A, the ability to easily position the paper is promoted. To facilitate picking up the paper to fold it, the recess 5 itself is again rounded off or bevelled.

It goes without saying that the aid according to the invention can be arranged to form part of other office equipment or office equipment which is integrated with the aid. For instance, it is possible have the aid form part of a desk pad or a pull-out shelf on a desk, or the aid may be equipped with a calculator of a pen-tray, or the aid may at the same time be suitable as mouse pad. The aid according to the invention is so cheap that every office employee can have one at his disposal so that no time is wasted walking to an automatic folding device.

I claim:

1. A paper folding aid made in one piece for folding paper of a standard size, in particular stationary, comprising a base plate (1), with the width of the base plate (1) at a position of the fold to be formed being at least the same as that of the paper (A) to be folded, said base plate being provided with position checks (2,3), which are affixed to the base plate and have heights extending up from the base plate to allow the paper (A), to be folded, and to be placed in a fixed position with one position check being along a long side of the paper (A), the position checks (2,3) being located so that they contact and align two adjacent sides of the paper (A), the position checks having sufficient lengths so as to extend over substantial portions of the respective sides of the paper that is positioned along side the position checks, one position check being of reduced height above the base plate at a level where a fold in the paper (A) is to be formed and being provided with a folding mark (4) which is visible next to a long side of the paper (A) near said reduced height of the one position check so that when the paper (A) is placed in the fixed position, a fold in said paper is conveniently made.

2. A paper folding aid according to claim 1, characterized in that the folding mark (4) is positioned at a distance of about ⅓ of the length of the standard size paper (A) from the along the one position check (3).

3. A paper folding aid according to claim 1, characterized in that the reduced height of the one position check is at least 0.5 mm and occurs at a distance of a little less than ⅔ of the length of the standard size paper (A) as measured from an edge of the paper that is away from the other position check (2).

4. A paper folding aid according to claim 1, characterized in that said base has a thickness of at least 4 mm thick and with the rim, at a side of the base plate (1) lying opposite a position check (2,3) against which the paper to be folded is placed, is rounded off or beveled along the thickness dimension so that said paper (A) has an exposed edge that can be conveniently manually lifted anywhere along said rim.

5. A folding aid according to claim 1, characterized in that the base plate (1) is at least 4 mm thick.

* * * * *